US012735811B2

(12) United States Patent
Yokoo et al.

(10) Patent No.: US 12,735,811 B2
(45) Date of Patent: Sep. 15, 2026

(54) POLYURETHANE ELASTIC FIBER, GATHER MEMBER CONTAINING SAME, AND SANITARY MATERIAL

(71) Applicant: Asahi Kasei Kabushiki Kaisha, Tokyo (JP)

(72) Inventors: Ryosuke Yokoo, Tokyo (JP); Keiichi Toyoda, Tokyo (JP); Shogo Ikeda, Tokyo (JP)

(73) Assignee: Asahi Kasei Kabushiki Kaisha, Tokyo (JP)

( * ) Notice: Subject to any disclaimer, the term of this patent is extended or adjusted under 35 U.S.C. 154(b) by 555 days.

(21) Appl. No.: 18/024,079

(22) PCT Filed: Sep. 7, 2021

(86) PCT No.: PCT/JP2021/032897
§ 371 (c)(1),
(2) Date: Mar. 1, 2023

(87) PCT Pub. No.: WO2022/054811
PCT Pub. Date: Mar. 17, 2022

(65) Prior Publication Data

US 2023/0272558 A1 Aug. 31, 2023

(30) Foreign Application Priority Data

Sep. 11, 2020 (JP) ..... 2020-152877

(51) Int. Cl.
*D01F 6/70* (2006.01)
*D01F 6/94* (2006.01)

(52) U.S. Cl.
CPC . *D01F 6/70* (2013.01); *D01F 6/94* (2013.01)

(58) Field of Classification Search
CPC ..... D01F 6/70; D01F 6/94
See application file for complete search history.

(56) References Cited

U.S. PATENT DOCUMENTS 3,111,369 A * 11/1963 Gregg ..... D01F 6/70 264/181
3,342,027 A * 9/1967 Mehler, Jr. ..... D01F 6/70 428/401

(Continued)

FOREIGN PATENT DOCUMENTS

CN 1274770 A 11/2000
CN 110249084 A 9/2019

(Continued)

OTHER PUBLICATIONS

JP-06200419_English Translation.*

(Continued)

*Primary Examiner* — Michael L Leonard
(74) *Attorney, Agent, or Firm* — Morgan, Lewis & Bockius LLP

(57) ABSTRACT

The present invention provides a thermoplastic polyurethane elastic fiber which exhibits excellent runnability during the production process of paper diapers. A polyurethane elastic fiber according to the present invention has the following characteristics: (a) the polyurethane elastic fiber is composed of a multifilament; (b) the total fineness thereof is from 160 dtex to 2,000 dtex; (c) the outflow start temperature thereof is from 160° C. to 220° C. as measured by a flow tester at an extrusion load of 49 N, a start temperature of 120° C. and a heating rate of 3° C./min; and (d) the bonding force between single yarns is 0.4 cN or more.

8 Claims, 1 Drawing Sheet

(56) References Cited

U.S. PATENT DOCUMENTS

| | | | | |
|---|---|---|---|---|
| 3,880,976 | A * | 4/1975 | Sumoto | C08K 5/20 525/88 |
| 5,800,920 | A | 9/1998 | Umezawa et al. | |
| 6,245,876 | B1 | 6/2001 | Hanahata et al. | |
| 6,248,197 | B1 | 6/2001 | Nakanishi et al. | |
| 7,255,820 | B2 | 8/2007 | Lee et al. | |
| 2005/0106982 | A1 | 5/2005 | Berrigan et al. | |
| 2010/0184347 | A1 | 7/2010 | Kojima et al. | |
| 2019/0226123 | A1 * | 7/2019 | Wamprecht | C08G 18/7664 |
| 2020/0190702 | A1 | 6/2020 | Sato et al. | |
| 2020/0270773 | A1 * | 8/2020 | Park | C08J 3/226 |
| 2021/0262122 | A1 * | 8/2021 | Lin | D01D 5/08 |

FOREIGN PATENT DOCUMENTS

| | | | | |
|---|---|---|---|---|
| JP | S39-29637 | B1 | 12/1964 | |
| JP | S43-22329 | B | 9/1968 | |
| JP | 53139847 | A * | 12/1978 | D01F 6/70 |
| JP | S53-139847 | A | 12/1978 | |
| JP | 06200419 | A * | 7/1994 | D01F 11/08 |
| JP | H06-200419 | A | 7/1994 | |
| JP | H10-72726 | A | 3/1998 | |
| JP | H11-323659 | A | 11/1999 | |
| JP | 2003-201618 | A | 7/2003 | |
| JP | 2004-052127 | A | 2/2004 | |
| JP | 2006-307409 | A | 11/2006 | |
| JP | 2009287125 | A * | 12/2009 | D01F 6/94 |
| JP | 2016-035122 | A | 3/2016 | |
| TW | 200536978 | A | 11/2005 | |
| TW | 200909625 | A | 3/2009 | |
| WO | 98/38364 | A1 | 9/1998 | |
| WO | 2015/055459 | A1 | 4/2015 | |
| WO | WO-2018147461 | A1 * | 8/2018 | D01F 6/94 |
| WO | 2019/078170 | A1 | 4/2019 | |
| WO | 2019/103013 | A1 | 5/2019 | |

OTHER PUBLICATIONS

Supplementary European Search Report issued in European Patent Application No. 21866770.7 dated Feb. 26, 2024.

International Search Report issued in corresponding International Patent Application No. PCT/JP2021/032897 dated Nov. 22, 2021.

International Preliminary Report on Patentability and Written Opinion issued in corresponding International Patent Application No. PCT/JP2021/032897 dated Mar. 23, 2023.

* cited by examiner

POLYURETHANE ELASTIC FIBER, GATHER MEMBER CONTAINING SAME, AND SANITARY MATERIAL

FIELD

The present invention relates to a polyurethane elastic fiber, and a gather member and a sanitary material comprising the same.

BACKGROUND

Polyurethane elastic fibers used as gathers in the waist and leg portions of sanitary applications such as disposable diapers are generally multifilaments having a large fineness of 160 dtex or more, and unlikely to result in yarn breakage from winding of a single yarn onto a guide or a transport roll during yarn running in the manufacturing process of disposable diapers. Normally, polyurethane urea elastic fibers which are dry-spun using an organic solvent as the spinning dope are used for this application. However, in recent years, there has been a demand for thermoplastic polyurethane elastic fibers spun by a melt spinning method that does not use an organic solvent, from the viewpoints of the environment, safety, and energy costs.

PTL 1 below discloses a thermoplastic polyurethane elastic yarn intended for knitted fabric applications, which has excellent processability and is less prone to yarn breakage and deterioration during thermal bonding of the yarn. Generally, there are different requirements, such as continuous use of multiple products, for yarn runnability in the manufacturing process of disposable diapers from that in the manufacturing process of knitted fabrics. However, PTL 1 only assumes knitted fabric applications, and does not disclose in detail a polyurethane elastic fiber having excellent yarn runnability in the manufacturing process of disposable diapers.

PTL 2 below discloses a multifilament elastic fiber having a fineness of 200 to 2200 dtex for disposable diapers. However, the manufacturing method thereof is a dry spinning method.

PTL 3 is known with respect to a melt-spun polyurethane elastic fiber for disposable diapers. However, PTL 3 does not specifically disclose a means for improving runnability.

Thus, a thermoplastic polyurethane fiber having a fineness of 160 dtex or more and excellent runnability in the manufacturing process of disposable diapers has not yet been discovered.

CITATION LIST

Patent Literature

[PTL 1] Japanese Unexamined Patent Publication (Kokai) No. 2006-307409

[PTL 2] Japanese Unexamined Patent Publication (Kokai) No. 2004-52127

[PTL 3] WO 2015/055459

SUMMARY

Technical Problem

In view of the prior art described above, an object of the present invention is to provide a thermoplastic polyurethane elastic fiber having excellent runnability in the manufacturing process of disposable diapers, and a gather member and a sanitary material comprising the same.

Solution to Problem

The present inventors have unexpectedly discovered that a thermoplastic polyurethane elastic fiber in which a multifilament having a large fineness of 160 dtex or more has an inter-yarn bonding force within a certain range has excellent runnability in the manufacturing process of disposable diapers, and have completed the present invention.

Specifically, the present invention is as follows.

[1] A polyurethane elastic fiber having the following features:

(a) being a multifilament;

(b) having a total fineness of 160 dtex or more and 2000 dtex or less;

(c) having an outflow start temperature in a flow tester of 160° C. or higher and 220° C. or lower under conditions of an extrusion load of 49 N, an initial temperature of 120° C., and a temperature elevation rate of 3° C./min; and (d) having an inter-yarn bonding force of 0.4 cN or more.

[2] The polyurethane elastic fiber according to the above [1], having a birefringence Δn of 0.010 or greater.

[3] The polyurethane elastic fiber according to the above [1] or [2], having a birefringence Δn of 0.025 or less.

[4] The polyurethane elastic fiber according to any of the above [1] to [3], containing greater than 0% by weight and 0.5% by weight or less of a saturated fatty acid metal salt and/or a fatty acid amide.

[5] The polyurethane elastic fiber according to any of the above [1] to [4], wherein a number of filaments (single yarns) is 3 or greater and an average value of inter-yarn bonding portion lengths in a cross-section of the polyurethane elastic fiber is 10 μm or more.

[6] The polyurethane elastic fiber according to any of the above [1] to [5], wherein stress at 90% recovery in a second cycle of a 200% extension/recovery repetition test is 0.015 cN/dtex or more.

[7] The polyurethane elastic fiber according to any of the above [1] to [6], having a single-yarn fineness of 5 dtex or more and 50 dtex or less.

[8] A gather member comprising the polyurethane elastic fiber according to any of the above [1] to [7].

[9] A sanitary material comprising the polyurethane elastic fiber according to any of the above [1] to [7].

Advantageous Effects of Invention

The polyurethane elastic fiber according to the present invention has excellent runnability in the manufacturing process of disposable diapers. In addition, a gather member and a sanitary material, which are other aspects of the present invention, have an appropriate tightening force, and thus the disposable diaper does not easily slip off or leak urine.

DESCRIPTION OF EMBODIMENTS

Figure 1:
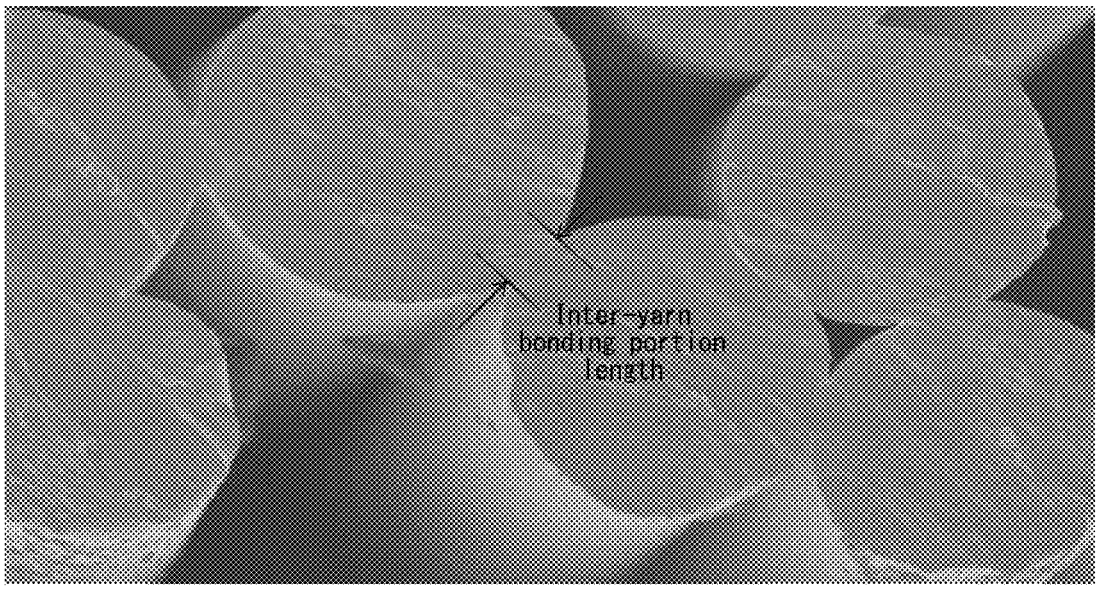
FIG. 1 is a picture showing an inter-yarn bonding portion length.

Hereinafter, embodiments of the present invention will be described. Note that, the present invention is not limited to the following embodiments, and various modifications can be made without departing from the scope thereof.

The polyurethane elastic fiber of the present embodiment is a polyurethane elastic fiber having the following features:

(a) being a multifilament;

(b) having a total fineness of 160 dtex or more and 2000 dtex or less;

(c) having an outflow start temperature of 160° C. or higher and 220° C. or lower under conditions of an extrusion load of 49 N, an initial temperature of 120° C., and a temperature elevation rate of 3° C./min; and (d) having an inter-yarn bonding force of 0.4 cN or more.

The polyurethane elastic fiber of the present embodiment is a multifilament (feature (a)). The number of filaments (single yarns) is not particularly limited as long as there are two or more.

The total fineness of the polyurethane elastic fiber of the present embodiment is 160 dtex or more and 2000 dtex or less (feature (b)). As described herein, fineness is calculated from a certain amount of yarn mass after winding. The total fineness is preferably 200 dtex or more and 1000 dtex or less, and more preferably 300 dtex or more and 700 dtex or less. When the total fineness is 160 dtex or more, tightening force in the gather portion is sufficient and the disposable diaper does not easily slip off. When the total fineness is less than 2000 dtex, the gather portion does not easily stiffen and sufficiently adheres to hot-melt.

The polyurethane elastic fiber of the present embodiment preferably has a single-yarn fineness of 5 dtex or more and 50 dtex or less. When the single-yarn fineness is 5 dtex or more, yarn breakage during spinning does not easily occur. When the single-yarn fineness is 50 dtex or less, cooling during spinning is more effective and a single yarn is more easily oriented, and thus sufficient stress at recovery can be easily obtained.

For the polyurethane elastic fiber of the present embodiment, the (c) outflow start temperature in a flow tester under the conditions of an extrusion load of 49 N, an initial temperature of 120° C., and a temperature elevation rate of 3° C./min is 160° C. or higher and 220° C. or lower, preferably 170° C. or higher and 215° C. or lower, and more preferably 180° C. or higher and 210° C. or lower. When the outflow start temperature is 160° C. or higher, heat resistance is sufficiently high and yarn breakage due to heat during hot-melt coating in the manufacturing process of disposable diapers does not easily occur. When the outflow start temperature is 220° C. or lower, melting at high temperatures during melt spinning is not required. Thus, thermal decomposition of urethane does not easily proceed and yarn breakage does not easily occur.

For the polyurethane elastic yarn of the present embodiment, the (d) inter-yarn bonding force is 0.4 cN or more. The inter-yarn bonding force is defined as the force required to separate a single yarn from a multifilament, and the specific measurement method thereof will be described in the Examples below. When the bonding force is 0.4 cN or more, occurrence of yarn breakage from single yarn winding around a guide due to yarn unraveling in the manufacturing process of disposable diapers, vibrations and oscillation of a running yarn, and tension fluctuations are small and runnability is satisfactory. The inter-yarn bonding force is preferably 0.6 cN or more. To keep the bonding force in the above range, it is preferable to adjust the spinning conditions so that the yarn temperature at the convergence position of the multifilament is 25° C. or higher. Note that, the term "inter-yarn bonding" refers to a state in which yarns are not simply in contact with each other but are joined by some force, and includes when being fused together. From the viewpoint of yarn runnability, yarns are preferably fused together. Further, the inter-yarn bonding force is preferably 3.0 cN or less, more preferably 2.5 cN or less, and even more preferably 2.0 cN or less. When the bonding force is 3.0 cN or less, stress at 90% recovery is sufficiently increased.

For the polyurethane elastic fiber of the present embodiment, the birefringence Δn is preferably 0.010 or greater, more preferably 0.013 or greater, and even more preferably 0.015 or greater. Further, the birefringence Δn is preferably 0.025 or less, more preferably 0.022 or less, and even more preferably 0.020 or less. When the birefringence Δn is 0.010 or greater, the polyurethane molecular chains are sufficiently oriented, and the stress at recovery is sufficiently increased. When the birefringence Δn is 0.025 or less, elongation is sufficiently increased. To keep the birefringence Δn in the above range, it is desirable to adjust the conditions (hereinafter, referred to as "spinning conditions") of spinning temperature, cold air temperature, cold air volume, spinning rate, and false-twist sites so that the yarn temperature at the convergence position of the multifilament is 20° C. to 50° C., whereby the spun yarn is oriented in a sufficiently cool state before convergence. Thus, the birefringence Δn falls within the above range.

The polyurethane elastic fiber of the present embodiment preferably contains greater than 0% by weight and 0.5% by weight or less of a saturated fatty acid metal salt and/or a saturated fatty acid amide. Normally, preventing tacking while maintaining single-yarn bonding force is difficult. However, by containing the saturated fatty acid metal salt or saturated fatty acid amide in the above range, single-yarn bonding force and tacking prevention can both be realized, and a yarn having satisfactory unwinding property and runnability can be obtained. By preventing tacking, a yarn having satisfactory unwinding property when the yarn is unwound at high speed from a wound body in the manufacturing process of disposable diapers can be obtained, and occurrence of yarn breakage from reverse winding, in which the yarn is wound around the wound body, and tension fluctuations when running yarn can be suppressed. The polyurethane elastic fiber of the present embodiment more preferably contains 0.2% by weight to 0.4% by weight of a saturated fatty acid metal salt and/or a saturated fatty acid amide.

The saturated fatty acid metal salt refers to a compound in which a saturated fatty acid and a metal are ionically bonded. The saturated fatty acid amide refers to an amide compound in which a saturated fatty acid and an amine are condensed. The saturated fatty acid constituting the saturated fatty acid metal salt and the saturated fatty acid amide is preferably a saturated fatty acid having 12 to 20 carbon atoms. Examples thereof include lauric acid, palmitic acid, stearic acid, and arachidic acid. Stearic acid is particularly preferable. Examples of the metal constituting the saturated fatty acid metal salt include magnesium, calcium, aluminum, and zinc, but magnesium is preferable. In addition, the amine constituting the saturated fatty acid amide can be a monoamine or a diamine. Examples of the monoamine include monomethylamine, dimethylamine, monoethylamine, diethylamine, monoethanolamine, and diethanolamine, and examples of the diamine include ethylenediamine and hexamethylenediamine, but ethylenediamine is preferable. Specifically, magnesium stearate is preferable as the saturated fatty acid metal salt, and ethylene bis stearamide is preferable as the saturated fatty acid amide.

For the polyurethane elastic fiber of the present embodiment, the stress at 90% recovery in the second cycle of a 200% extension/recovery repetition test is preferably 0.015 cN/dtex or more. When the stress at 90% recovery in the second cycle of a 200% extension/recovery repetition test is 0.015 cN/dtex or more, the tightening force is sufficient when the polyurethane elastic fiber is used as a gather for a disposable diaper, and the disposable diaper does not easily slip off or leak urine.

For the polyurethane elastic fiber of the present embodiment, the elongation at break is preferably 300% or greater, more preferably 400% or greater, and even more preferably 450% or greater. When the elongation is 300% or greater, yarn breakage does not easily occur in the manufacturing process of disposable diapers. By finely adjusting the spinning conditions and controlling the polymer viscosity and spinning tension during spinning, the orientation of the fiber is adjusted, and the elongation can thereby be achieved.

For the polyurethane elastic yarn of the present embodiment, it is preferable that the number of filaments be two or greater and the average value of inter-yarn bonding portion lengths in a cross-section of the polyurethane elastic fiber be 10 μm or more. The average value of inter-yarn bonding portion lengths is more preferably 11 μm or more, and even more preferably 12 μm or more. The measurement method for the average value of inter-yarn bonding portion lengths in a cross-section will be described in detail in the Examples below. When the average value of inter-yarn bonding portion lengths is 10 μm or more, the inter-yarn bonding force is sufficiently high and the yarn runnability in the manufacturing process of disposable diapers is satisfactory. To keep the average value of inter-yarn bonding portion lengths in the above range, it is preferable to adjust the spinning conditions so that the yarn temperature at the convergence position of the multifilament is 25° C. or higher.

The polyurethane elastic yarn of the present embodiment preferably comprises a polyol, an organic diisocyanate compound, and a polyurethane resin that is a polymer of an active hydrogen-containing compound.

The polyol is preferably a polyalkylene ether diol, a polyester diol, or a polycarbonate diol, which are commonly used in the polymerization of thermoplastic polyurethanes, particularly preferably a polyalkylene ether diol, and preferably has a number average molecular weight of 900 to 3,000. Examples of the polyalkylene ether diol include ones in which the alkylene group is a tetramethylene group and ones comprising a tetramethylene group and a linear or branched alkylene group having 1 to 8 carbon atoms. Specifically, polytetramethylene ether diol, copolymerized poly(tetramethylene-neopentylene) ether diol, and copolymerized poly(tetramethylene-2-methylbutylene) ether diol are preferable.

As the organic diisocyanate, for example, of aliphatic, alicyclic, and aromatic diisocyanates, all those that are soluble or liquid under reaction conditions can be applied. Specific examples thereof include methylene-bis(4-phenyl isocyanate), methylene-bis(3-methyl-4-phenyl isocyanate), 2,4,-tolylene diisocyanate, 2,6-tolylene diisocyanate, m- and p-xylylene diisocyanate, α,α,α',α'-tetramethyl-xylylene diisocyanate, m- and p-phenylene diisocyanate, 4,4'-dimethyl-1,3-xylylene diisocyanate, 1-alkylphenylene-2,4-and-2,6-diisocyanate, 3-(a-isocyanatoethyl) phenyl isocyanate, 2,6-diethylphenylene-1,4-diisocyanate, diphenyl-dimethylmethane-4,4-diisocyanate, diphenyl ether-4,4'-diisocyanate, naphthylene-1,5-diisocyanate, 1,6-hexamethylene diisocyanate, methylene-bis(4-cyclohexyl isocyanate), 1,3- and 1,4-cyclohexylene diisocyanate, trimethylene diisocyanate, tetramethylene diisocyanate, pentamethylene diisocyanate, hexamethylene diisocyanate, and isophorone diisocyanate. Methylene-bis(4-phenyl isocyanate) is particularly preferable.

As the active hydrogen-containing compound that reacts with an isocyanate group, for example, low-molecular-weight glycols can be used. Specific examples thereof include ethylene glycol, 1,2-propylene glycol, 1,3-propylene glycol, 2,2-dimethyl-1,3-propanediol, 1,4-butanediol, 1,3-butanediol, hexamethylene glycol, diethylene glycol, 1,10-decanediol, 1,3-dimethylolcyclohexane, and 1,4-dimethylolcyclohexane. Alkanolamines such as 2-amino-1-ethanol, 3-amino-1-propanol, 4-amino-1-butanol, and 5-amino-1-pentanol can also be used. 1,4-Butanediol is particularly preferable as the active hydrogen-containing compound that reacts with an isocyanate group.

The polyurethane elastic yarn of the present embodiment may comprise a stabilizer as needed. Examples of the stabilizer include compounds commonly in polyurethane resins, such as UV absorbers, antioxidants, photostabilizers, gas-resistant stabilizers, and antistatic agents. In addition, an anti-tacking agent and a treatment agent may be added during spinning as needed. As the anti-tacking agent, the saturated fatty acid metal salt or saturated fatty acid amide described above is preferable. As components of the treatment agent, known substances such as dimethyl silicone and a mineral oil can be used. A treatment agent comprising one or more of dimethyl silicone, a mineral oil, a higher alcohol having 8 to 25 carbon atoms and an OH group at an end thereof, polyalkylene ether glycols, and polyurethane compounds of a polyalkylene ether glycol and an organic diisocyanate is preferable.

The polyurethane resin contained in the polyurethane elastic fiber of the present embodiment can be manufactured using a known polyurethanization reaction technique, and may be manufactured by either a one-shot method or a prepolymer method. In the case of a prepolymer method, a polyol and an organic diisocyanate in a molar ratio of 1:1.8 to 3.0, preferably 1:2.2 to 2.5, are added into a reaction tank equipped with a hot water jacket and a stirrer under a nitrogen purge and a prepolymer reaction is carried out at 40 to 100° C., more preferably 50 to 80° C., whereby a prepolymer having two terminal isocyanate groups is obtained. An active hydrogen-containing compound is then added to the prepolymer having two terminal isocyanate groups in an equivalent amount approximately equal to the number of functional groups in the isocyanate terminal groups, and a chain extension reaction is carried out. The equivalent ratio thereof to the isocyanate terminal groups is preferably 0.95 to 1.1, and more preferably 0.99 to 1.05. Thereafter, solid-phase polymerization can be carried out to obtain a polyurethane having a predetermined molecular weight. As a method for chain extension and solid-phase polymerization, an active hydrogen compound may be added into a batch reaction vessel containing the prepolymer at 40 to 100° C., and then discharged as-is, subjected to solid-phase polymerization at 60 to 200° C., preferably at 80 to 130° C., and pelletized to obtain polymer chips. After uniformly mixing the prepolymer and the solid-phase polymer and using a cylindrical pipe or twin-screw extruder to set the cylinder temperature of the polymerization zone to 180 to 240° C. to continuously or semi-continuously obtain a polymer, solid-phase polymerization may be carried out at 60 to 200° C., preferably at 80 to 140° C.

The molecular weight (Mw) of the resulting polyurethane resin, when measured using a polystyrene standard by GPC, is generally 100,000 to 800,000, and is preferably 150,000 to 500,000 and more preferably 200,000 to 400,000.

The spinning method is not particularly limited as long as the desired physical properties are obtained. Examples thereof include, in addition to a method in which polyurethane resin chips are charged into an extruder, heated, and melt-spun, a method in which polyurethane resin chips are melted and then mixed with a polyisocyanate compound to be spun, and a method in which a reaction product of the prepolymer having two terminal isocyanate groups and the active hydrogen compound is added to the prepolymer having two terminal isocyanate groups, and the mixture is continuously spun without being processed into chips.

The polyurethane resin charged into the extruder is metered with a metering pump and introduced into the spinning head. Foreign matter is removed by filtration using a wire mesh or glass beads inside the spinning head as needed. The product is then discharged from the spinneret, air-cooled in a cold air chamber, treated with a treatment agent, and wound up via a godet roll.

In the spinning process, die temperature, cold air wind speed, cold air temperature, convergence position and spinning rate are adjusted to precisely control the temperature profile of the fiber and the spinning tension. The die temperature is preferably 180° C. to 220° C., and more preferably 200° C. to 210° C. A general cooling method for melt spinning, such as a method in which cold air is applied perpendicularly to the running direction of the yarn from directly below the spinneret, is used. The cold air wind speed is preferably 0.2 m/s to 2.0 m/s, and more preferably 0.5 m/s to 1.2 m/s. The cold air temperature is preferably 5° C. to 20° C., and more preferably 7° C. to 15° C. The convergence position is used as a method for joining a multifilament. A false twister is installed between the spinneret and the godet roll. Depending on the strength of the twist, the twist is propagated from a lower portion, filaments converge onto each other, and the height of the convergence point is controlled. For the false twisting method, a general method can be selected. Air false twisting using an air nozzle or a ring false twister in which filaments are brought into contact with a rotating ring can be used. The convergence position can be defined as the distance from the spinneret to the point where the filaments converge, and is preferably 800 to 1700 mm, more preferably 1000 to 1600 mm, and even more preferably 1200 to 1400 mm, whereby the orientation of the yarn by cooling and the yarn temperature at the convergence position can be controlled, and a fiber that is excellent in both stress at recovery from extension and adhesive force can be obtained.

A gather member and a sanitary material comprising the polyurethane elastic fiber of the present embodiment are also aspects of the present invention. Specific examples of the sanitary material include absorbent articles typified by disposable diapers and sanitary products, masks, and bandages. In a disposable diaper, a gather member in which elastic fibers are bonded to a nonwoven fabric via hot melt is used for the waist and leg portions. The polyurethane elastic fiber of the present embodiment can be suitably used for such parts. The polyurethane elastic fiber of the present embodiment can be used to manufacture gather members and sanitary materials that have satisfactory runnability in the manufacturing process of disposable diapers and excellent tightening force.

EXAMPLES

Hereinafter, the present invention will be specifically described with reference to the Examples and Comparative Examples. However, the present invention is not limited only to these examples. Measurement values in the Examples are determined by the following measurement methods. In the present embodiment, sampling is carried out from the manufactured wound body. However, if the sampling below cannot be carried out due to restrictions such as sample size, a reasonable sampling method and measurement method may be adopted.

(1) Outflow Start Temperature

Using a Shimadzu CFT-500D flow tester (manufactured by Shimadzu Corporation), an extrusion load of 49 N was applied to a sample amount of 1.5 g, under the conditions of a die (nozzle) diameter of 0.5 mm and a thickness of 1.0 mm. After preheating at an initial set temperature of 120° C. for 240 s, the temperature was elevated at a constant rate of 3° C./min, and a plunger stroke-temperature curve drawn at that time was obtained. As the temperature was elevated at a constant rate, the sample was gradually heated and the polymer started to flow out. The flow temperature at this time was designated as the outflow start temperature. When the temperature was further elevated, the melted polymer outflow increased, and the plunger descent stopped and ended. Temperature was measured three times, and the average temperature was used as the outflow start temperature. Note that, for the measurement sample, 1.5 g of yarn was unwound from the same wound body, and without any pretreatment such as removal of treatment agents such as oil, the yarn was rounded, cut into four equal parts, and used.

(2) Inter-Yarn Bonding Force

Measurement was carried out in an atmosphere of 20° C. and 65% RH with an EZ-SX Autograph manufactured by Shimadzu Corporation. For the measurement of the inter-yarn bonding force, a single yarn was separated from the multifilament using tweezers, and the single yarn was pulled out by about 3 cm. At that time, the single yarn that was pulled out was pinched by the lower chuck while the remaining multifilament from the pulled-out yarn was pinched by the upper chuck. The clamping length was set to 5 cm. The multifilament was pulled vertically at a speed of 500 mm/min to separate the single yarn from the multifilament. Slack in the yarn was removed, and stress from the point when the yarn started to separate until the end of the measurement when the yarn was separated 150 mm was measured. The average value of stress peaks when the yarn was separated 150 mm was used as the bonding force. Five samples were collected at intervals of 5 m, the bonding force was measured for each, and the average value thereof was determined.

(3) Elongation at Break

Using an AGS-500NG Autograph tester manufactured by Shimadzu Corporation, measurement was carried out under the conditions of a temperature of 20° C. and a humidity of 65%. The elongation at break was measured when an elastic yarn having a clamp length of 5 cm was extended at a speed of 500 mm/min. Five samples were collected at intervals of 5 m, the elongation at break for each was measured, and the average value thereof was determined.

(4) Measurement of Stress at 90% Recovery in Second Cycle of 200% Extension/Recovery Repetition Test Using an AGS-500NG Autograph tester manufactured by Shimadzu Corporation, measurement was carried out under the conditions of a temperature of 20° C. and a humidity of 65%. The stress at recovery in the second 90% elongation when extension and recovery up to 200% at a speed of 500 mm/min were repeated twice on a sample having a clamp length of 5 cm was designated as the stress at 90% recovery in the second cycle. It is considered that the higher the value thereof, the higher the tightening force of the fiber. Five samples were collected at intervals of 5 m, the stress at 90% recovery for each was measured, and the average value thereof was determined.

(5) Birefringence Δn

A compensator U-CTB manufactured by Olympus Corporation was attached to a polarizing microscope BX-51P manufactured by Olympus Corporation to measure Δn. Five samples were collected at intervals of 5 m and measured, and the average value of the measurements was determined.

(6) Average Value of Inter-Yarn Bonding Portion Lengths in Cross-Section

A cross-section cut perpendicular to the yarn length direction of the polyurethane elastic fiber was photographed with SEM. From the cross-sectional photograph, at the portion where single yarns located on the outer periphery of the multifilament are bonded, the length of the line segment connecting two furthest bonding points as shown in FIG. 1 was measured. The lengths of all bonding points for single yarns located on the outer periphery were measured and divided by the number of measurements to determine an average. Note that, the multifilament yarn for taking the SEM photograph of the cross-section was immersed in liquid nitrogen for 10 s or more before cutting, cut perpendicularly to the length direction of a single yarn with a razor blade, and set on the SEM stage for observation so that the cross-section can be observed from the front. The measurement magnification of the SEM was set to an appropriate magnification so that the entire cross-section of the multifilament can be observed. In the Examples and Comparative Examples, the measurement was carried out in the range of 100 to 300×. For the number of measurements, five samples were taken from the same wound body at intervals of 1 m or more. The sum of the average lengths of the bonding portions determined from each cross-section was divided by 5, and the resulting value was used as the average value of the bonding portion length.

(7) Fineness

A polyurethane elastic fiber was stripped from the wound body so as to be subjected to tension, measured to a length of 1 m in a non-tensioned state without slack, and cut off. The cut fiber was weighed, and fineness was determined from the following formula:

$$\text{Fineness (dt)}=10000\times\text{weight (g) per m}$$

Measurement was carried out five times, and the average value was used as the fineness. For the total fineness, one multifilament was measured by the above method. The total fineness was divided by the number of yarns to obtain the single-yarn fineness.

(8) Yarn Temperature at Convergence Position

Using an infrared thermography camera InfRecR550Pro manufactured by Nippon Avionics Co., Ltd., when spinning at an ambient temperature of 25° C., the camera was fixed at a position 100 mm away from the yarn at the height of a convergence position, and a thermal image focusing on the converged yarn was taken. The emissivity of the material to be measured was set to 0.9. A black rubber plate was placed 30 mm behind the running yarn to minimize the effect of heat reflection from the external environment. The temperature at the top of the convergence position was extracted from the thermal image taken, and this temperature was used as the yarn temperature at convergence position.

(9) Runnability

Figure 2:
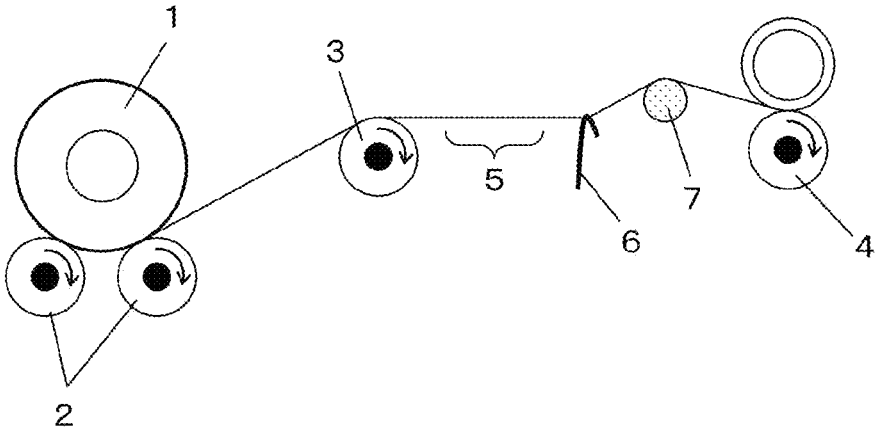
FIG. 2 is a schematic diagram showing an evaluation method for runnability.

The elastic fiber wound body 1 obtained by spinning was mounted to the apparatus shown in FIG. 2. The elastic fiber feeding roll 2 was run at a speed of 50 m/min, the pre-draft roll 3 wound with the elastic fiber three times at a speed of 80 m/min, and the take-up roll 4 at a speed of 85 m/min. The behavior of the elastic fiber at observation site 5 was visually observed for 3 min and evaluated according to the following evaluation criteria.

5 points: yarn swing width of 0 mm or more and less than 2 mm 4 points: yarn swing width of 2 mm or more and less than 4 mm 3 points: yarn swing width of 4 mm or more and less than 6 mm 2 points: yarn swing width of 6 mm or more 1 point: yarn breakage If runnability is 3 points or more, the yarn is less likely to break during the manufacturing process of disposable diapers, resulting in a final yarn having satisfactory stretchability for a gather. If runnability is 2 points or less, yarn breakage is likely to occur in the manufacturing process of disposable diapers, resulting in a decrease in productivity of disposable diapers.

(10) Unwinding Property

After spinning, 150 g of the elastic fiber was wound onto a paper tube, and 15 g of the elastic fiber was then unwound and stripped therefrom. The wound body after stripping 15 g was left to stand on a creel stand. The yarn was then creeled in the vertical direction, run horizontally through a dogtail guide, and wound onto a winding roll 2 m away at a speed of 15 m/min. An online tension meter (tension pickup Z-2, range 50 g, manufactured by Eiko Sokki, Inc.) was installed 1 m before the take-up roll. Measurements were taken for 3 min, and the average value thereof was used as the unwinding tension. It is considered that the smaller the value thereof, the better the yarn release from a wound body, and in turn the more satisfactory the unwinding property. Unwinding property was evaluated according to the following criteria.

5 points: unwinding tension of less than 3 g 4 points: unwinding tension of 3 g or more and less than 5 g 3 points: unwinding tension of 5 g or more and less than 7 g 2 points: unwinding tension of 7 g or more and less than 10 g 1 point: unwinding tension of 10 g or more If unwinding property is 3 points or more, a yarn having satisfactory release when unwound at high speed from a wound body in the manufacturing process of disposable diapers is obtained, and the occurrences of yarn breakage due to reverse winding, in which the yarn is wound around the wound body, and tension fluctuations when running the yarn are easily suppressed.

Example 1

2400 g of polytetramethylene ether diol having a number average molecular weight of 1800 and 750.75 g of 4,4'-diphenylmethane diisocyanate were reacted under stirring in a dry nitrogen atmosphere at 60° C. for 3 h to obtain a terminal isocyanate-capped polyurethane prepolymer. The reaction solution was mixed with 9 g of AO-60, manufactured by Adeka, as an antioxidant and 9 g of LA-36, manufactured by Adeka, as an ultraviolet absorber. 150.95 g of 1,4-butanediol was then further added to the mixture and stirred for 15 min to obtain a polyurethane having a viscosity of 200 Pa's (30° C.).

The polyurethane was then dispensed on a Teflon™ tray and annealed with the tray in a hot-air oven at 110° C. for 19 h to obtain a polyurethane resin. The polyurethane resin had a Shore A hardness of 75 and thermoplastic properties.

The obtained polyurethane resin was pulverized into a powder of about 3 mm by a UG-280 pulverizer manufactured by Horai Co., Ltd. To the polyurethane resin powder was added 0.35 parts by mass of dried ethylene bis stearamide, and the mixture was charged from a hopper and melted in an extruder. The mixture was weighed and pressurized with a gear pump installed on the head, filtered with a filter, and discharged at a die temperature of 210° C. from a nozzle having 60 holes with a diameter of 0.23 mm each at a discharge rate of 31 g/min. Cold air having a cold air wind speed of 0.6 m/s and a cold air temperature of 16° C. was blown out from a cold air chamber having a cold air length of 900 mm and applied perpendicularly to the fiber. Using a ring-type false twister installed 5 m underneath, twist was propagated. The convergence position, which is the distance from the spinneret to the position of twist propagation, was set to 1400 mm. While applying a treatment agent mainly composed of polydimethylsiloxane and a mineral oil, the fiber was wound at a speed of 500 m/min to obtain a polyurethane elastic fiber having a single-yarn fineness of 10 dtex and a total fineness of 620 dtex. The yarn temperature at the convergence position was 30° C., and the application rate of the treatment agent to the polyurethane elastic fiber was 2 parts by mass. Various functional evaluations are shown in Table 3 below. There were obtained fibers having an excellent stress at 90% recovery in the second cycle of the 200% extension/recovery repetition test, which is an index of tightening force, and satisfactory runnability scored 4 points in the runnability evaluation. Various performance evaluation results of the elastic fiber are shown in Table 1 below.

Example 2

Except that the rotational speed of the contact ring-type false twister was adjusted and the convergence position was set at 1000 mm, a polyurethane fiber was obtained in Example 2 in the same manner as in Example 1. Various performance evaluation results of the elastic fiber are shown in Table 1 below.

Example 3

Except that the rotational speed of the ring-type false twister was adjusted and the convergence position was set at 800 mm, a polyurethane fiber was obtained in Example 3 in the same manner as in Example 1. Various performance evaluation results of the elastic fiber are shown in Table 1 below.

Example 4

Except that a nozzle having 36 holes with a diameter of 0.35 mm each was mounted to the spinneret, the die temperature was set to 215° C., the discharge rate was set to 43.4 g/min from the nozzle, cold air was set to a temperature of 15° C. and a wind speed of 0.7 m/s, and winding was carried out at a speed of 700/min, a polyurethane fiber was obtained in Example 4 in the same manner as in Example 1. The resulting single-yarn fineness was 17 dtex, and the total fineness was 620 dtex. Various performance evaluation results of the elastic fiber are shown in Table 1 below.

Example 5

Except that the rotational speed of the contact ring-type false twister was adjusted and the convergence position was set at a position of 1000 mm, a polyurethane fiber was obtained in Example 5 in the same manner as in Example 4. Various performance evaluation results of the elastic fiber are shown in Table 1 below.

Example 6

Except that a nozzle having 24 holes with a diameter of 0.5 mm each was mounted to the spinneret, the die temperature was set to 220° C., the discharge rate was set to 62 g/min from the nozzle, cold air was set to a temperature of 14° C. and a wind speed of 0.8 m/s, and winding was carried out at a speed of 1000/min, a polyurethane fiber was obtained in Example 6 in the same manner as in Example 4. The resulting fiber had a single-yarn fineness of 26 dtex and a total fineness of 620 dtex. Various performance evaluation results of the elastic fiber are shown in Table 1 below.

Example 7

Except that a nozzle having 16 holes with a diameter of 0.5 mm each was mounted to the spinneret, the die temperature was set to 210° C., the discharge rate was set to 83 g/min from the nozzle, cold air was set to a temperature of 14° C. and a wind speed of 0.8 m/s, and winding was carried out at a speed of 1400/min, a polyurethane fiber was obtained in Example 7 in the same manner as in Example 4. The resulting fiber had a single-yarn fineness of 40 dtex and a total fineness of 620 dtex. Various performance evaluation results of the elastic fiber are shown in Table 1 below.

Example 8

Except that dried ethylene bis stearamide was not added to the polyurethane resin powder and the cold air temperature was set to 16° C. and the cold air wind speed to 0.7 m/s, a polyurethane fiber was obtained in Example 8 in the same manner as in Example 1. Various performance evaluation results of the elastic fiber are shown in Table 1 below.

Example 9

Except that 0.35 parts by mass of dried magnesium stearate was added to the polyurethane resin powder without adding ethylene bis stearamide, a polyurethane fiber was obtained in Example 9 in the same manner as in Example 1. Various performance evaluation results of the elastic fiber are shown in Table 1 below.

Example 10

Except that the discharge temperature was set to 200° C., the cold air temperature to 15° C., and the cold air wind speed to 0.8 m/s, a polyurethane fiber was obtained in Example 10 in the same manner as in Example 4. Various performance evaluation results of the elastic fiber are shown in Table 1 below.

Example 11

Except that 0.6 parts by mass of dried ethylene bis stearamide was added to the polyurethane resin powder and the convergence position was set at 1200 mm, a polyurethane elastic fiber was obtained in Example 11 in the same manner as in Example 1. Various performance evaluation results of the elastic fiber are shown in Table 1 below.

Example 12

Except that the die temperature was set to 230° C., the cold air temperature to 15° C., the cold air speed to 0.7 m/s, and the convergence position at a position of 700 mm, a polyurethane fiber was obtained in Example 12 in the same manner as in Example 4. Various performance evaluation results of the elastic fiber are shown in Table 1 below.

Comparative Example 1

Except that the cold air temperature was set to 16° C., the cold air wind speed to 0.6 m/s, and the convergence position at 1800 mm, a polyurethane elastic fiber was obtained in Comparative Example 1 in the same manner as in Example 4. The elastic fiber of Comparative Example 1 had a single-yarn bonding force of 0.3 cN and scored 2 points in the runnability evaluation, due to the convergence not being at an appropriate position. Runnability was insufficient. Various performance evaluation results of the elastic fiber are shown in Table 1 below.

Comparative Example 2

Except that the convergence position was set at 4500 mm, a polyurethane elastic fiber was obtained in Comparative Example 2 in the same manner as in Comparative Example 1. The elastic fiber of Comparative Example 2 had a single-yarn bonding force of 0.2 cN and a score of 1 in runnability evaluation, due to the convergence position not being at an appropriate position. Runnability was insufficient. Various performance evaluation results of the elastic fiber are shown in Table 1 below.

Comparative Example 3

Except that the die temperature was set to 190° C., the cold air temperature to 15° C., and cold air speed to 0.9 m/s, a polyurethane elastic fiber was obtained in Comparative Example 3 in the same manner as in Example 1. Since the elastic fiber of Comparative Example 3 had a low discharge temperature and a high cold air wind speed, the yarn temperature at the convergence position during spinning was too low, and single yarns could not be joined together, the elastic fiber had a low adhesive force and scored 1 point for the runnability evaluation. Further, the yarn was excessively cooled during spinning and too much orientation was applied, resulting in elongation as low as 280%. Many of the yarns could not withstand the draw ratio for runnability evaluation, and yarn breakage occurred frequently. Various performance evaluation results of the elastic fiber are shown in Table 1 below.

Comparative Example 4

Except that the polyurethane resin powder was melted in an extruder without adding dried ethylene bis stearamide, a nozzle having 36 holes with a diameter of 0.35 mm each was mounted to the spinneret, the die temperature was set to 208° C., the discharge amount was set to 37.2 g/min from the nozzle, cold air was set to a temperature of 16° C. and a wind speed of 0.5 m/s, the convergence position was set at 2200 mm, and winding was carried out at a speed of 600/min, a polyurethane fiber was obtained in Comparative Example 4 in the same manner as in Example 1. The resulting yarn had a low single-yarn bonding force and scored 2 points in the runnability evaluation. Runnability was insufficient. Various performance evaluation results of the elastic fiber are shown in Table 1 below.

TABLE 1

| | Total fineness (dtex) | Single-yarn fineness (dtex/F) | Outflow start temperature (° C.) | Saturated fatty acid bisamide (wt %) | Magnesium stearate (wt %) | Elongation (%) | Stress at 90% recovery in second cycle of 200% extension/recovery repetition test (cN/dtex) | Birefringence (—) | Inter-yarn bonding force (cN) |
|---|---|---|---|---|---|---|---|---|---|
| Example 1 | 620 | 10 | 182 | 0.35 | 0 | 540 | 0.023 | 0.014 | 0.5 |
| Example 2 | 620 | 10 | 182 | 0.35 | 0 | 580 | 0.021 | 0.016 | 0.5 |
| Example 3 | 620 | 10 | 181 | 0.35 | 0 | 600 | 0.019 | 0.016 | 0.7 |
| Example 4 | 620 | 17 | 180 | 0.35 | 0 | 500 | 0.018 | 0.01 | 0.9 |
| Example 5 | 620 | 17 | 181 | 0.35 | 0 | 560 | 0.020 | 0.01 | 1.0 |
| Example 6 | 620 | 26 | 178 | 0.35 | 0 | 440 | 0.018 | 0.012 | 1.0 |
| Example 7 | 620 | 40 | 179 | 0.35 | 0 | 500 | 0.023 | 0.012 | 1.4 |
| Example 8 | 620 | 10 | 175 | 0 | 0 | 530 | 0.021 | 0.017 | 1.8 |
| Example 9 | 620 | 10 | 180 | 0 | 0.35 | 520 | 0.02 | 0.016 | 0.6 |
| Example 10 | 900 | 25 | 182 | 0.35 | 0 | 640 | 0.019 | 0.01 | 1.2 |
| Example 11 | 620 | 10 | 184 | 0.60 | 0 | 560 | 0.018 | 0.015 | 0.4 |
| Example 12 | 620 | 17 | 174 | 0.35 | 0 | 700 | 0.013 | 0.008 | 1.2 |
| Comparative Example 1 | 620 | 17 | 183 | 0.35 | 0 | 440 | 0.02 | 0.015 | 0.3 |
| Comparative Example 2 | 620 | 17 | 184 | 0.35 | 0 | 370 | 0.025 | 0.02 | 0.2 |
| Comparative Example 3 | 620 | 10 | 183 | 0.35 | 0 | 280 | 0.024 | 0.011 | 0.2 |
| Comparative Example 4 | 620 | 10 | 187 | 0 | 0 | 655 | 0.021 | 0.015 | 0.3 |

TABLE 1-continued

| | Inter-yarn bonding portion length (μm) | Spinning rate (m/min) | Die temperature (° C.) | Cold air temperature (° C.) | Cold air speed (m/s) | Convergence position (mm) | Yarn temperature at convergence position (° C.) | Runnability (point) | Unwinding property (point) |
|---|---|---|---|---|---|---|---|---|---|
| Example 1 | 10.1 | 500 | 210 | 16 | 0.6 | 1400 | 27 | 4 | 4 |
| Example 2 | 10.5 | 500 | 210 | 16 | 0.6 | 1000 | 30 | 4 | 4 |
| Example 3 | 10.3 | 500 | 210 | 16 | 0.6 | 800 | 31 | 5 | 3 |
| Example 4 | 10.5 | 700 | 215 | 15 | 0.7 | 1400 | 32 | 5 | 4 |
| Example 5 | 11.8 | 700 | 215 | 15 | 0.7 | 1000 | 37 | 5 | 4 |
| Example 6 | 11.6 | 1000 | 220 | 14 | 0.8 | 1400 | 43 | 5 | 3 |
| Example 7 | 12.3 | 1400 | 220 | 14 | 0.8 | 1400 | 45 | 5 | 3 |
| Example 8 | 10.3 | 500 | 210 | 15 | 0.7 | 1400 | 28 | 5 | 1 |
| Example 9 | 9.9 | 500 | 208 | 16 | 0.7 | 1400 | 29 | 4 | 3 |
| Example 10 | 11.3 | 700 | 215 | 14 | 0.8 | 1400 | 35 | 4 | 3 |
| Example 11 | 9.3 | 500 | 210 | 16 | 0.6 | 1200 | 29 | 3 | 5 |
| Example 12 | 10.8 | 700 | 230 | 16 | 0.6 | 700 | 53 | 4 | 3 |
| Comparative Example 1 | 8.9 | 700 | 215 | 16 | 0.6 | 1800 | 25 | 2 | 3 |
| Comparative Example 2 | 8.2 | 700 | 215 | 16 | 0.6 | 4500 | 23 | 1 | 2 |
| Comparative Example 3 | 9.3 | 500 | 190 | 14 | 0.9 | 1400 | 24 | 1 | 2 |
| Comparative Example 4 | 8.3 | 600 | 208 | 16 | 0.5 | 2200 | 23 | 2 | 1 |

INDUSTRIAL APPLICABILITY

The polyurethane elastic fiber of the present invention has excellent filament bonding force, satisfactory runnability during the manufacturing process of disposable diapers, and excellent tightening force. Thus, the polyurethane elastic fiber of the present invention can be suitably used as elastic members of the gather and stretch portions for sanitary materials such as disposable diapers.

REFERENCE SIGNS LIST

1 wound body of elastic fiber
2 feeding roll
3 pre-draft roll
4 winding roll
5 observation site
6 ceramic hook guide
7 bearing-free roller

The invention claimed is:

1. A thermoplastic polyurethane elastic fiber having the following features:

(a) being a multifilament;

(b) having a total fineness of 160 dtex or more and 2000 dtex or less;

(c) an outflow start temperature in a flow tester of 160° C. or higher and 220° C. or lower under conditions of an extrusion load of 49 N, an initial temperature of 120° C., and a temperature elevation rate of 3° C./min;

(d) having an inter-yarn bonding force of 0.4 cN or more; and (e) having a birefringence Δn of 0.010 or greater.

2. The polyurethane elastic fiber according to claim 1, having a birefringence Δn of 0.025 or less.

3. The polyurethane elastic fiber according to claim 1, containing greater than 0% by weight and 0.5% by weight or less of a saturated fatty acid metal salt and/or a saturated fatty acid amide.

4. The polyurethane elastic fiber according to claim 1, wherein a number of filaments (single yarns) is 3 or greater and an average value of inter-yarn bonding portion lengths in a cross-section of the polyurethane elastic fiber is 10 μm or more.

5. The polyurethane elastic fiber according to claim 1, wherein stress at 90% recovery in a second cycle of a 200% extension/recovery repetition test is 0.015 cN/dtex or more.

6. The polyurethane elastic fiber according to claim 1, having a single-yarn fineness of 5 dtex or more and 50 dtex or less.

7. A gather member comprising the polyurethane elastic fiber according to claim 1.

8. A sanitary material comprising the polyurethane elastic fiber according to claim 1.

* * * * *